United States Patent [19]

Evertz et al.

[11] Patent Number: 4,586,557

[45] Date of Patent: May 6, 1986

[54] ONE-PIECE, OPEN-ENDED, WATER-COOLED CONTINUOUS CASTING MOULD AND METHOD OF MAKING THE SAME

[75] Inventors: Egon Evertz, Vorlander strasse 23, 5650 Solingen, Fed. Rep. of Germany; Rolf Seybold, Solingen, Fed. Rep. of Germany

[73] Assignee: Egon Evertz, Solingen, Fed. Rep. of Germany

[21] Appl. No.: 598,006

[22] Filed: Apr. 9, 1984

[30] Foreign Application Priority Data

Apr. 14, 1983 [DE] Fed. Rep. of Germany ..... 3313503

[51] Int. Cl.[4] ..... B22D 11/00

[52] U.S. Cl. ..... 164/418; 164/75; 164/97; 164/119; 427/135

[58] Field of Search ..... 164/97, 98, 75, 100, 164/72, 132, DIG. 2, 418, 138; 427/135

[56] References Cited

U.S. PATENT DOCUMENTS

| | | | |
|---|---|---|---|
| Re. 30,979 | 6/1982 | Watts | 164/119 |
| 938,688 | 11/1909 | Nichols | 164/75 |
| 3,450,189 | 6/1969 | McDonald | 164/95 |
| 3,595,300 | 7/1971 | Long | 164/100 |
| 4,197,902 | 4/1980 | Von Jan et al. | 164/418 |
| 4,239,078 | 12/1980 | Tarmann | 164/418 |

FOREIGN PATENT DOCUMENTS

| | | | |
|---|---|---|---|
| 52-56018 | 5/1977 | Japan | 164/418 |
| 56-91964 | 7/1981 | Japan | 164/418 |
| 1215184 | 12/1970 | United Kingdom | 164/97 |
| 806237 | 2/1981 | U.S.S.R. . | |

*Primary Examiner*—W. D. Bray

*Attorney, Agent, or Firm*—Holman & Stern

[57] ABSTRACT

A one-piece open-ended water-cooled continuous casting mold and a method of making it to improve the service life of such mold made up from galvanically precipitated layers of which an inner layer consists of a wear-resistant metal such as nickel and an exterior layer is made particularly from copper. After the mold has been manufactured and while still on the core it may be further improved by application of external pressure.

20 Claims, 2 Drawing Figures

ONE-PIECE, OPEN-ENDED, WATER-COOLED CONTINUOUS CASTING MOULD AND METHOD OF MAKING THE SAME

BACKGROUND OF THE INVENTION

1. Field of the Invention

The invention relates to a one-piece, open-ended, water-cooled continuous casting mold, especially intended for use in casting steel, and to a method of making such a mold.

2. Description of the Prior Art

One-piece, open-ended, water-cooled molds are generally used for casting billet formats up to 160 mm. edge length and also for smaller bloom formats. Whereas formerly the molds were formed from a forged bloom with cooling bores, nowadays they are generally made of thin-walled construction from a drawn copper tube which is secured in a water cooling box so that the mold in that box is surrounded by a water jacket in which water flows in contraflow direction relative to the molten steel flowing through the mold and washes evenly around the mold walls. Molds of this type are described in "Handbuch des Stranggiessens" (Continuous casting manual) 1958, page 395.

In split molds for continuous casting of the type used for casting larger cross-section formats of billets and particularly slabs, it is also known to deposit metallic layers of nickel out of electrolyte solutions on the inside of the mold with a view to improving the service life of the molds and with a view to reducing the susceptibility of the castings produced therein to longitudinal, transverse and cross-cracking and also reducing the effects of damage to the mold which may be caused by the cold casting. To this end German No. OS 30 38 289, for example, specifies a current-carrying as well as also a current-less nickel deposition or plating process in which hard-material particles are also admixed to the nickel. However, with one-piece, open-ended water-cooled continuous casting molds such internal galvanic plating could not be successfully achieved because the 1/100 mm. dimensional precision requirement can only be met by very expensive internal machining. For this reason one-piece open-ended continuous casting chill molds consisting of drawn copper tube have a comparatively short service life at the end of which they are usually scrapped.

BRIEF SUMMARY OF THE INVENTION

It is the object of the invention to improve a one-piece, open-ended water-cooled continuous casting mold of the known type in the sense of achieving longer service life and rendering it less sensitive to damage being caused by the cold casting. It is also the aim of the invention to provide a casting mold which will reduce the various cracking phenomena in the cast billets.

In accordance with the invention there is provided a one-piece, open-ended, water-cooled continuous casting mold characterised in that it consists of galvanically deposited layers of which an inner layer of a wear-resistant metal such as nickel is deposited in a layer thickness up to 35% of the total mold wall thickness on a smooth core which defines the exact geometrical cross-sectional shape of the mold and in that its two end faces are machined accurately for mounting in a water-cooled box.

In accordance with a further aspect of the invention, there is provided a method of making a mold as above defined, characterized in that the inner layer is deposited at a reduced current density (relative to that used for the outer layer) of about 1 $A/dm^2$, with a lower metal content and a lower temperature of the electrolyte and/or higher pH content of the same.

The new open-ended continuous casting mold basically differs from the previously known types of molds in that it has a different microstructure and receives a different type of surface treatment. In fact it no longer requires any kind of fine machining or finishing work in the mold interior because the inside measurement, like the required internal smoothness, are predetermined by the core which is superficially shaped and treated in the way which is desired for the inside wall of the mold. Furthermore, by comparison with the known nickel-plating of the copper applied to slab molds, there is the advantage that the galvanic deposition results in a material bonding which safely precludes any risk of detachment of one layer from the other. Owing to the dense metallic structure heat flow remains unimpeded also in the transitional region between inner and outer layers so that the cooling performance of a mold of this type is very satisfactory. Both end faces of the new mold are accurately shaped in accordance with the volume and surface of the water box in the region of the pipe connections thereof. In other words, an important feature of the invention resides in providing the correct position and dimensional accuracy for mounting the mold in the water cooling box. Suitable sealing means may also be applied, for example by providing a groove for the engagement therein of a sealing bead or the like.

Preferably, an external pressure is applied to the new mold after it is formed in as much as by this means it is possible to eliminate tension stress which builds up during the plating processes. Moreover, application of pressure produces a hardening effect at the exterior surface of the mold and facilitates detachment of the finished mold from the core. With advantage a method according to this invention also involves the provision of a hardened metal core provided with a separating layer and a conducting layer on top of the same so that application of pressure may also be applied to the core. According to one aspect of a method of this invention, the whole core is preferably of greater length than that of the mold. This means that the mold is produced with a certain amount of over-dimensioning or oversize at the end faces thereof so that the precise measurement of the mold between its two end faces may then be obtained by mechanical treatment, i.e. machining.

The external compression applied to the mold after formation may, incidentally, be applied in various ways, which also include cutting treatment. Particularly suitable for this purpose is also a cold-drawing process although in that case certain limitations in respect of the curvature of the hollow mold interior must be taken into account. Apart from this however, the configuration of the hollow mold space is subject to no restriction in respect of either its curvature or its conicity provided that the mold is executed in accordance with the invention.

Conveniently the inner layer of the mold, particularly consisting of nickel, is up to about 2 mm. thick. This limitation in the thickness of the inner layer is recommended because, depending on the materials which are used and the specified overall thickness, it will not produce any significant change in thermal dissipation conditions. Furthermore it must be remembered that, particularly when using nickel (which is preferred for reasons connected with hardness, mechanical strength and corrosion-resistance), residual internal strain values may become very high with increasing thickness. Whilst such residual internal strain may be reduced to zero value by adding, for example organic sulphur compounds, this means inevitably that such organic compounds will then also be present in the plating layer and correspondingly modify its remaining characteristics in a detrimental manner. For this reason it is better to apply electrolyte solutions which do not include additives of this type. As a general guide for the electrolyte solutions to be used, one may take those which are used for electrolytic as well as for currentless nickel deposition according to German No. OS 30 38 289. With a layer thickness of only up to approximately 2 mm. the internal layer may be produced not only adequately strain-free but also acceptably free from adversely acting admixtures.

In principle, the new mold may consist of galvanically precipitated layers of just one single material, such as copper or nickel. However, with special advantage the inside layer is made of nickel and the exterior layer of copper. As already described this process produces a compound material body with properties which are optimally adapted to the envisaged purpose of application. Successful adherence of a very thin inside layer presupposes that for this layer the thickness is as far as possible uniform or constant in the whole precipitation zone.

This requirement is met by a corresponding throwing power of the electrolyte. This is achieved particularly by the proposal for practical application of a method according to this invention according to which the deposition conditions for the inner layer are different from those for the exterior layer. Thus, for the inner layer, if this is deposited with current, current density is reduced to approximately 1 $A/dm^2$ only whereas for the outer layer it is of the order of about 3 $A/dm^2$. Furthermore, irrespective of whether current is applied or a currentless method used, for deposition of the inner layer the metal content of the solution and its temperature are reduced and/or the pH content of the solution is increased in order to improve throwing power.

In a particularly advantageous embodiment a method according to the invention provides precipitation or deposition of the various layers of the mold on a core which may consist of a metal and which is provided first with a separating layer and then with a conducting layer thereon top, followed by surface treatment and application of compression to the mold on the same core. The application of compression may also be combined with further deformation in the case of straight, that is to say non-radiussed open-ended continuous casting molds.

BRIEF DESCRIPTIONS OF THE DRAWINGS

A further description of the invention in greater detail follows with reference to the accompanying drawing wherein FIG. 1 is a schematic cross-sectional view of one embodiment of the invention; and FIG. 2 is a view similar to FIG. 1 showing only the mold and rolling operation.

DETAILED DESCRIPTION

Figure 1:
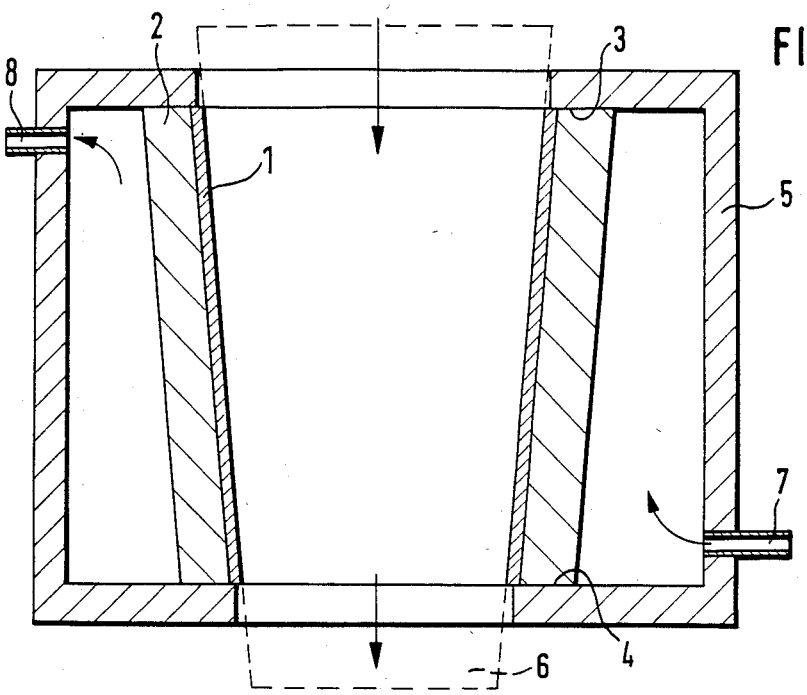

The open-ended continuous-casting chill mold shown in the drawing consists of an inner layer 1 which is deposited on a slightly conical core 6 indicated in broken lines. This conical core 6 which may consist of a non-metallic material, for instance plastics material or, in special cases as hereinbefore described, of metal such as steel, is previously provided with a separating or parting layer using parting media which are commonly used in plating work such as not only organic insulating substances like oil or wax, but, particularly considered from the point of view of dimensional accuracy which is highly desired according to this invention, also very thin layers of coatings of metallic salts of the kind obtained with a metal core by treating it in borate-chromate-oxalate, sulphide-and iodite solutions. Brushed-on graphite dust is also suitable not only for the conducting layer but also for the parting layer. In known manner the core may also be given a chemical silver-plating for easy separation thereof from the galvanically deposited end product. With some metals which form thin oxide layers, such as with chrome-nickel steels, it is often possible to dispense altogether with the provision of a parting layer. The conducting layer is then applied in known manner. On plastics cores this may be done by chemical silver-plating. Brushing with graphite however is one of the best known methods of obtaining a conducting layer.

On such a core 6 which has been treated as hereinbefore described, there is then first of all deposited by galvanic precipitation a layer 1 which consists of nickel which is then followed by a considerably thicker copper layer 2. Although the throwing or scatter power of the nickel deposition is very good the surface of the deposited layer is still less smooth than that of a mechanically finished layer. However, it is precisely this surface irregularity which results in the formation of a particularly firm bond with the copper layer. It was found that, particularly with prolonged service or use of the mold, diffusion processes take place in the marginal zone of the two layers which favour and facilitate a close material bonding process.

The top and bottom end faces 3 and 4 of the mold are mechanically worked or machined so that they are suitable for sealed connection to a water cooling box 5. The latter is provided with feed pipes 7 so that the water flows in contra-flow through the water jacket relative to the flow of molten metal and is discharged through the outlet pipe 8.

The treatment of the core which preferably consists of steel starts with the application of a micro-fissurized chromium layer which is about 1$\mu$ thick. This layer is deposited by precipitation from a solution in which 240 to 320 grams chromic anhydride ($CrO_2$) are dissolved per liter of water. To this solution there is further added 0.1% sulphuric acid ($H_2SO_4$). The chrome layer is then deposited under application of a comparatively high current density of 15 to 24 $A/dm^2$. This layer is then subjected to hot water treatment which gives rise to cracking and formation of micro-fissurization. At the same time the chrome-layer is particularly reliably passivated by hot water treatment so that it offers good parting conditions.

The aforementioned chrome-layer is then subjected to a treatment with a sulphuric acid-copper-sulphate solution in which about 240 g $CuSO_4$ and 60 g $H_2SO_4$ are contained in solution per liter, to which are further added from 90 to 100 mg $Cl^-$ per liter. On Application of a 4 to 6 $A/dm^2$ density current this will produce the deposition of a very thin layer of copper which fills the micro-fissures and forms a thin coating of approximately 1.5μ.

The formation of the actual inner layer of the mould takes place in a nickel-sulphamate-bath containing approximately 80 g nickel-sulphamate/L, 3 g $Cl^-$/liter and 40 g $H_3BO_3$/liter. In this process current density is from 1 to 2 A/dm$^2$ in order to achieve a fine deposit. When the layer is about 2 mm. thick the exterior copper layer of the mold is precipitated thereon out of the aforementioned acid copper bath, but in this case working only with a current density of 1 to 1.5 A/dm$^2$.

Figure 2:
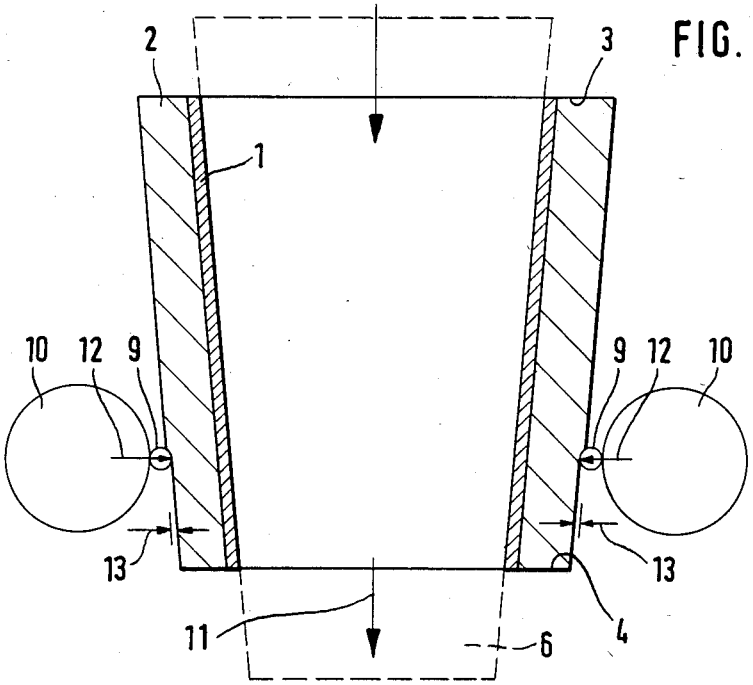

At this stage the mold is still on the core. Whilst remaining on this core it is subjected to external compression (see FIG. 2) in the direction of arrows 12 applied by means of a thin roll 9 backed by a heavier roll 10, the thickness of roll a being inferior to the thickness of the mold walls. This ensures that mold wall thickness is subjected to an overall reduction of approximately 0.5%, shown exaggerated at 13, by the treatment particularly in the vicinity of the exterior copper layer to which the roll is directly applied, which achieves a particularly desirable strengthening of the said exterior copper layer so that the latter is not only very largely smooth after such treatment but also has improved resistance to mechanical loads and stresses. In this compression operation while the mold is on the core 6, rolls 9 are pressed by roller 10 against the exterior surface of the mold and the mold is moved in the direction of arrow 11. Whether the mold is generally conical in shape, as shown in the drawing, or a straight cylinder, the rolls are adapted to produce a uniform reduction in wall thickness in a suitable manner known to those skilled in the art.

We claim:

1. A method of making a one-piece, open-ended, water-cooled continuous casting mold comprising:

providing a smooth metal core having a smooth surface defining the exact geometrical cross-sectional shape of the mold and a length greater than the length of the mold;

depositing on said core a parting layer 1μ thick of chromium;

treating said chromium layer in hot water to produce micro-fissures in the surface of said layer;

depositing a conducting layer of a light copper coating on said chromium layer which fills in said micro-fissures;

galvanically depositing a coating of nickel on said copper coating approximately 2 mm thick to form an inner wear-resistant metal layer;

galvanically depositing on said nickel coating an exterior copper layer approximately twice the thickness as said inner nickel layer;

removing said core from the mold; and accurately machining the two end faces of the mold for mounting in a water-cooled box.

2. A method as claimed in claim 1 and further comprising:

prior to removing said core, strengthening the exterior coating of the mold by the application of external compression to the external surface thereof.

3. A method as claimed in claim 1 and further comprising machining the exterior surface of the mold.

4. A method as claimed in claim 2 and further comprising machining the exterior surface of the mold.

5. A method as claimed in claim 2 wherein said application of external compression comprises a cold-drawing process.

6. A method as claimed in claim 2 wherein said application of external compression comprises rolling the external surface to reduce the thickness of the mold wall.

7. A method of making a one-piece, open-ended water-cooled continuous casting mold comprising:

providing a smooth core defining the exact geometrical cross-sectional shape of the mold;

galvanically depositing a coating of nickel on said core to form an inner layer of wear-resistant metal having a thickness of up to 35% of the total wall thickness of the mold;

galvanically depositing on said nickel coating an external coating of a metal having high thermal conductivity;

applying external compression to the external surface of said external coating to strengthen said external coating;

removing said core from said mold; and accurately machining the two end faces of the mold for mounting in a water-cooled box.

8. A method as claimed in claim 7 wherein said inner layer is deposited by electrolytic deposition at a reduced current density (relative to that used for the outer layer) of about 1 A/dm$^2$, with a lower metal content and a lower temperature of the electrolyte.

9. A method as claimed in claim 7 wherein said external compression is applied to the exterior surface of the mold by rolling with rolls to reduce the thickness of the mold walls.

10. A method according to claim 9 wherein the rolls have a smaller diameter than the thickness of the mold walls, and further comprising supporting the rolls during the application of pressure by substantially heavier backing rolls, and the thickness of the mold walls is reduced by about 0.5% by the pressure application treatment.

11. A method as claimed in claim 7 and further comprising machining the exterior surface of the mold.

12. A method as claimed in claim 7 wherein said external coating is copper.

13. A method as claimed in claim 7 wherein said inner layer is deposited by electrolytic deposition at a reduced current density (relative to that used for the outer layer) of about 1 A/dm$^2$, with a lower metal content and a higher pH content of the electrolyte.

14. A method as claimed in claim 8 wherein said pH content of the electrolyte for forming the inner layer is higher than that for forming the external layer.

15. A method as claimed in claim 7 and further comprising:

prior to said nickel coating step, depositing a parting layer on said core; and depositing conducting layer on said parting layer, so that said nickel coating is deposited on said conducting layer.

16. A method as claimed in claim 15 wherein said parting layer comprises chromium and said conducting layer comprises copper.

17. A one-piece, open-ended mold for use as a water-cooled continuous casting mold comprising:

a galvanically deposited inner layer of wear-resistant material and a galvanically deposited external layer on the outer surface of said inner layer, wherein said inner layer has a thickness of up to 35% of the total mold wall thickness, made by the process recited in claim 7.

18. A mold as claimed in claim 17 wherein:

said inner layer is comprised of nickel; and said external layer is comprised of copper.

19. A mold as claimed in claim 18 and further comprising hard material particles dispersed in said inner layer.

20. A one-piece, open-ended mold for use as a water-cooled continuous casting mold comprising:

a galvanically deposited inner layer of wear-resistant material and a galvanically deposited external layer on the outer surface of said inner layer, wherein said inner layer has a thickness of up to 35% of the total mold wall thickness, made by the process recited in claim 1.

* * * * *